US009057507B2

(12) United States Patent
Lin et al.

(10) Patent No.: US 9,057,507 B2
(45) Date of Patent: Jun. 16, 2015

(54) LED LAMP

(71) Applicant: ADVANCED OPTOELECTRONIC TECHNOLOGY, INC., Hsinchu Hsien (TW)

(72) Inventors: Hao-Xiang Lin, Hsinchu (TW); Ming-Ta Tsai, Hsinchu (TW); Chung-Min Chang, Hsinchu (TW)

(73) Assignee: ADVANCED OPTOELECTRONIC TECHNOLOGY, INC., Hsinchu Hsien (TW)

( * ) Notice: Subject to any disclaimer, the term of this patent is extended or adjusted under 35 U.S.C. 154(b) by 0 days.

(21) Appl. No.: 14/327,756

(22) Filed: Jul. 10, 2014

(65) Prior Publication Data

US 2015/0015134 A1 Jan. 15, 2015

(30) Foreign Application Priority Data

Jul. 12, 2013 (CN) ..... 2013 1 0292396

(51) Int. Cl.
*F21V 29/02* (2006.01)

(52) U.S. Cl.
CPC ..... *F21V 29/02* (2013.01); *F21V 29/673* (2015.01)

(58) Field of Classification Search
CPC ..... F21V 29/673; F21V 29/02; F21V 29/22; F21V 29/25; F21V 29/27
USPC ..... 362/249.02, 545, 226, 231, 247, 800
See application file for complete search history.

(56) References Cited

U.S. PATENT DOCUMENTS 8,123,381 B1 * 2/2012 Wray ..... 362/294

* cited by examiner

*Primary Examiner* — Anne Hines
(74) *Attorney, Agent, or Firm* — Novak Druce Connolly Bove + Quigg LLP

(57) ABSTRACT

An LED lamp includes an envelope, a circuit board, a plurality of LEDs, a lamp body and a lamp holder. The LEDs are arranged on the circuit board. The envelope covers the LEDs. The lamp body is connected between the envelope and the lamp holder. The lamp body includes a first chamber and a second chamber. The lamp body defines therein a plurality of first channels and a second channels. The first channels are defined adjacent to the envelope. The second channels are defined in the vicinity of the lamp holder.

20 Claims, 1 Drawing Sheet

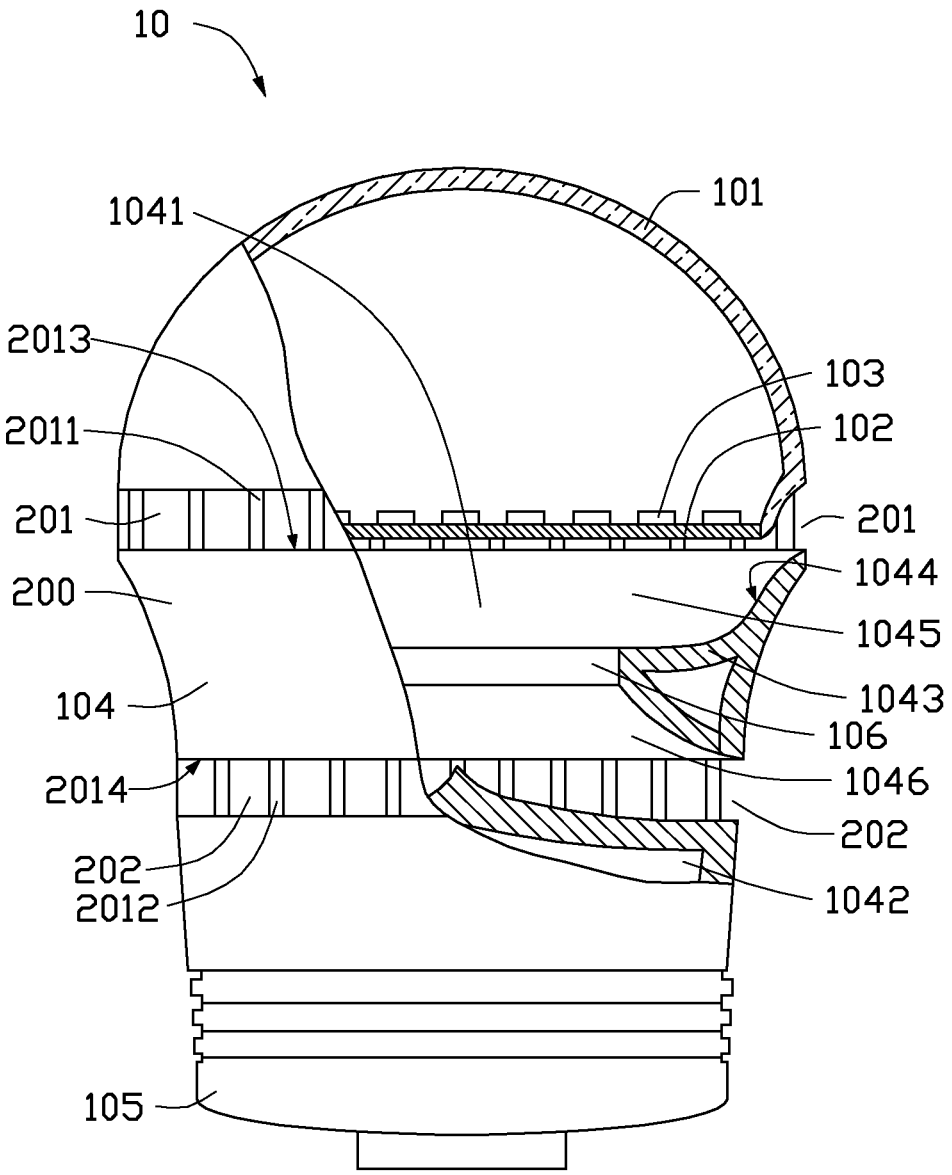
10
101
1041
2013
103
2011
102
201
201
1044
200
1045
1043
104
106
2014
1046
202
202
2012
1042
105

LED LAMP

FIELD

The disclosure relates to an LED (light emitting diode) lamp, and particularly to an LED lamp with high heat dissipation performance.

BACKGROUND

Heat generated from an LED lamp may cause a high temperature of the LED lamp, which has a bad effect for a performance and security of the LED lamp.

BRIEF DESCRIPTION OF THE DRAWINGS

Implementations of the present technology will now be described, by way of example only, with reference to the attached figure.

The only drawing is a part-section view showing an LED lamp in accordance with an exemplary embodiment of the present disclosure.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The only drawing is not necessarily to scale and the proportions of certain parts have been exaggerated to better illustrate details and features of the present disclosure.

Referring to FIG. 1, an LED lamp 10 comprises an envelope 101, a circuit board 102, a plurality of LEDs 103, a lamp body 104 and a lamp holder 105. The LEDs 103 are arranged on the circuit board 102. The envelope 101 covers the LEDs 103. The lamp body 104 is connected between the envelope 101 and the LED holder 105. The LEDs 103 are electrically mounted on the circuit board 102 and the circuit board 102 is electrically connected with the LED holder 105. In this embodiment, the circuit board 102 can be coupled to the lamp body 104. In other embodiments, the circuit board 102 can be coupled to the envelope 101.

The lamp body 104 can be made of plastic, thereby decreasing a weight of the LED lamp 10. The lamp body 104 comprises a first chamber 1041 and a second chamber 1042 defined therein. The first chamber 1041 can be defined in top of the lamp body 104 and face the envelope 101. The second chamber 1042 can be defined in bottom of the lamp body 104 and face the lamp holder 105. The second chamber 1042 is separated from the first chamber 1041. A driver (not shown) used for driving the LEDs 103 can be received in the second chamber 1042.

A plurality of first channels 201 and a plurality of second channels 202 are defined on a periphery side 200 of the lamp body 104. The first channels 201 are more adjacent to the envelope 101 compared with the second channels. The second channels 202 are defined in the vicinity of the lamp holder 105. In this embodiment, the second channels 202 are defined in the middle of the lamp body 104. Air can flow from the first chamber 1041 to an outside of the lamp body 104 through the first channels 201 or the second channels 202, thereby cooling the LED lamp 10. The first chamber 1041 has a first opening 2013 to face the envelope 101 and a second opening 2014 in the middle of the lamp body 104. The first and second channels 201, 202 are communicated with the first chamber 1041 via the first opening 2013 and the second opening 2014 respectively. In this embodiment, the lamp body 104 includes a plurality of first connecting parts 2011 surrounding the first opening 2013 and a plurality of second connecting parts 2012 surrounding the second opening 2014 of the first chamber 1041. The first connecting parts 2011 are coupled to the envelope 101. Each first channel 201 is defined between two adjacent first connecting parts 2011. Each second channel 202 is defined between two adjacent second connecting parts 2012. In an alternative embodiment, the first channels 201 can be defined in the envelope 101.

The LED lamp 10 can be used as ceiling lamp, whereby the envelope 101 faces toward the ground, and cooling air can enter the first chamber 1041 through the first channels 201, and exit to the outside of the LED lamp 10 through the second channels 202 after absorption of heat in the first chamber 1041 which is generated by the LEDs 103. The LED lamp 10 can be used as ground embedded lamp, whereby the envelope 101 faces opposite to the ground, and cooling air can enter the first chamber 1041 through the second channels 202, and exit to the outside of the LED lamp 10 through the first channels 201 after absorption of heat in the first chamber 1041 which is generated by the LEDs 103. The LED lamp 10 also can be used in other environments, and the first and second channels 201, 202 formed on the lamp body 104 can enhance a circulation of air in the first chamber 1041 and provide good heat dissipation performance of the LED lamp 10.

A ratio of areas of the first channels 201 and the second channels 202 to an area of an outside surface of the lamp body 104 is defined as X, the ratio X is from 0.1 to 0.6. When the ratio X is less than 0.1, the amount of air flowing between the first chamber 1041 and the outside of the lamp body 104 is limited since the first channels 201 and the second channels 202 are too small in size, which weakens the heat dissipation performance. When the ratio X is larger than 0.6, the lamp body 104 has a low mechanical strength, which weakens stability of the LED lamp 10.

The LED lamp 10 further has a fan 106. The fan 106 can be arranged in the first chamber 1041. The fan 106 can increase speed of air flowing between the first chamber 1041 and the outside of the lamp body 104. A support 1043 can be formed in the first chamber 1041 for coupling to the fan 106. The support 1043 can be extended from an inside surface 1044 of the lamp body 104. The support 1043 can be a circle-shaped. The fan 106 positioned at the support 1043 divides the first chamber 1041 into a first part 1045 and a second part 1046. Air can enter to the first part 1045 of the first chamber 1041 through the first channels 201, flow from the first part 1045 to the second part 1046 through the fan 106, and exit from the second part 1046 to the outside of the LED lamp 10 through the second channels 202 with an accelerated speed when the fan 106 is operated. The fan 106 can also be electrically connected to the driver received in the second chamber 1042.

Furthermore, a streamlined design can be performed on the inside surface 1044 of the first chamber 1041, which can decrease resistance of air flowing in the first channels 201, the second channels 202 and the first chamber 1041, thereby increasing the speed of air flowing and improving the heat dissipation performance of the LED lamp 10.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

The embodiments shown and described above are only examples. Many details are often found in the art such as the other features of an LED lamp. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An LED lamp comprising:

a lamp holder;

a lamp body connected to the lamp holder, the lamp body having a first chamber defined therein;

a circuit board received in the lamp body; and a plurality of LEDs arranged on and electrically connected to the circuit board;

wherein a plurality of first channels and a plurality of second channels are defined in the lamp body and communicated with the first chamber, the first channels are far away from the lamp holder, the second channels are defined in the vicinity of the lamp holder, and air flows from the first chamber to an outside of the lamp body through the first channels or the second channel, a ratio of areas of the first channels and the second channels to an area of an outside surface of the lamp body is from 0.1 to 0.6.

2. The LED lamp of claim 1, further comprising an envelope connected to the lamp body and covering the LEDs.

3. The LED lamp of claim 2, wherein the first chamber is defined in top of the lamp body and faces the envelope, the lamp body further has the second chamber defined in bottom of the lamp body, and separated from the first chamber and facing the lamp holder.

4. The LED lamp of claim 2, wherein the first channels and the second channels are defined on a periphery side of the lamp body, the first chamber has a first opening to face the envelope and a second opening in the middle of the lamp body, and the first channels and the second channels are communicated with the first chamber via the first opening and the second opening respectively.

5. The LED lamp of claim 4, wherein a plurality of first connecting parts surrounds the first opening and are coupled with the envelope, each first channel is defined between two adjacent first connecting parts.

6. The LED lamp of claim 5, wherein a plurality of second connecting parts surrounds the second opening of the first chamber, each second channel is defined between two adjacent second connecting parts.

7. The LED lamp of claim 2, wherein the circuit board is coupled to the envelope.

8. The LED lamp of claim 1, wherein the circuit board is coupled to the lamp body.

9. The LED lamp of claim 1, further comprising: a fan arranged in the first chamber of the lamp body.

10. The LED lamp of claim 9, further comprising: a support formed in the first chamber for coupling to the fan, wherein the support are extended from an inside surface of the lamp body.

11. The LED lamp of claim 10, wherein the support is a circle-shaped.

12. The LED lamp of claim 9, wherein the first chamber is divided by the fan into a first part and a second part, and speed of air flowing through the first channels, the first part and the second part of the first chamber, and the second channels is accelerated by the fan.

13. The LED lamp of claim 1, further comprising an envelope connected to the lamp body and covering the LEDs.

14. The LED lamp of claim 13, wherein the first chamber is defined in top of the lamp body and faces the envelope, the lamp body further has the second chamber defined in bottom of the lamp body, and separated from the first chamber and facing the lamp holder.

15. The LED lamp of claim 13, wherein the first channels and the second channels are defined on a periphery side of the lamp body, the first chamber has a first opening to face the envelope and a second opening in the middle of the lamp body, and the first channels and the second channels are communicated with the first chamber via the first opening and the second opening respectively.

16. The LED lamp of claim 15, wherein a plurality of first connecting parts surrounds the first opening and are coupled with the envelope, each first channel is defined between two adjacent first connecting parts.

17. The LED lamp of claim 16, wherein a plurality of second connecting parts surrounds the second opening of the first chamber, each second channel is defined between two adjacent second connecting parts.

18. An LED lamp comprising:

a lamp body having a chamber defined therein, and at least one first channel and at least one second channel defined therein for communicating with the chamber;

a plurality of LEDs arranged in the lamp body;

an envelope connected to a top of the lamp body and covering the LEDs; and a lamp holder positioned at a bottom of the lamp body and electrically connected to the LEDs;

wherein at least one first channel is defined far away from the lamp holder, and the at least one second channel is defined near the lamp holder compared with the at least one first channel, a ratio of areas of the first channels and the second channels to an area of an outside surface of the lamp body is from 0.1 to 0.6.

19. An LED lamp comprising:

a lamp holder;

a lamp body connected to the lamp holder, the lamp body having a first chamber defined therein;

a circuit board received in the lamp body;

a plurality of LEDs arranged on and electrically connected to the circuit board; and an envelope connected to the lamp body and covering the LEDs;

wherein a plurality of first channels and a plurality of second channels are defined in the lamp body and communicated with the first chamber, the first channels are far away from the lamp holder, the second channels are defined in the vicinity of the lamp holder, and air flows from the first chamber to an outside of the lamp body through the first channels or the second channel, the first chamber is defined in top of the lamp body and faces the envelope, the lamp body further has the second chamber defined in bottom of the lamp body, and separated from the first chamber and facing the lamp holder, the first channels and the second channels are defined on a periphery side of the lamp body, the first chamber has a first opening to face the envelope and a second opening in the middle of the lamp body, and the first channels and the second channels are communicated with the first chamber via the first opening and the second opening respectively, a plurality of first connecting parts surrounds the first opening and are coupled with the envelope, each first channel is defined between two adjacent first connecting parts.

20. The LED lamp of claim 19, wherein a plurality of second connecting parts surrounds the second opening of the first chamber, each second channel is defined between two adjacent second connecting parts.

* * * * *